US009975269B2

(12) United States Patent
Koegel

(10) Patent No.: US 9,975,269 B2
(45) Date of Patent: May 22, 2018

(54) GUARD DETECTION SYSTEM FOR A POWER TOOL

(71) Applicants: Robert Bosch Tool Corporation, Broadview, IL (US); Robert Bosch GmbH, Stuttgart (DE)

(72) Inventor: Jan Koegel, Oak Park, IL (US)

(73) Assignees: Robert Bosch Tool Corporation, Broadview, IL (US); Robert Bosch GmbH, Stuttgart (DE)

( * ) Notice: Subject to any disclaimer, the term of this patent is extended or adjusted under 35 U.S.C. 154(b) by 447 days.

(21) Appl. No.: 14/205,583

(22) Filed: Mar. 12, 2014

(65) Prior Publication Data

US 2014/0311310 A1 Oct. 23, 2014

Related U.S. Application Data

(60) Provisional application No. 61/776,823, filed on Mar. 12, 2013.

(51) Int. Cl.

| | |
|---|---|
| ***B27G 19/00*** | (2006.01) |
| ***B27G 19/08*** | (2006.01) |
| ***B27G 19/02*** | (2006.01) |

(52) U.S. Cl.

CPC ..... *B27G 19/08* (2013.01); *B27G 19/02* (2013.01); *Y10T 83/141* (2015.04)

(58) Field of Classification Search

CPC ..... B27G 19/00; B27G 19/02; B23D 59/00; B27B 5/38; Y10T 83/606

USPC ..... 83/522.1, 397.1, 522.12, 72

See application file for complete search history.

(56) References Cited

U.S. PATENT DOCUMENTS

| | | | | |
|---|---|---|---|---|
| 4,033,218 | A * | 7/1977 | Donatelle | 83/478 |
| 6,418,829 | B1 * | 7/2002 | Pilchowski | B23D 59/001 83/397 |
| 2004/0060178 | A1 * | 4/2004 | Willer | B27G 19/04 30/391 |
| 2007/0186739 | A1 * | 8/2007 | Peot et al. | 83/102.1 |
| 2008/0078470 | A1 * | 4/2008 | O'Branion et al. | 144/356 |
| 2010/0024620 | A1 | 2/2010 | Arvey | |
| 2010/0257990 | A1 * | 10/2010 | Schell et al. | 83/397 |

(Continued)

OTHER PUBLICATIONS

International Search Report and Written Opinion corresponding to PCT Application No. PCT/US2014/023978, dated Jul. 11, 2014 (13 pages)

*Primary Examiner* — Andrea Wellington
*Assistant Examiner* — Fernando Ayala
(74) *Attorney, Agent, or Firm* — Maginot Moore & Beck LLP

(57) ABSTRACT

A power table saw has a saw blade driven by a motor with power selectively supplied to the motor by actuation of a switch. A riving knife is selectively positioned in an extended position and a retracted position relative to the blade. A blade guard is removably mounted to the riving knife above the blade. A sensible element on the riving knife can be detected by a first sensor when the riving knife is retracted, the first sensor has a non-null state when the sensible element is adjacent the first sensor and a null state otherwise. A second sensor has a null state when the blade guard is detected and a non-null state otherwise. A controller determines the states of the sensors and disengages power to the motor when the switch is actuated when the states of the sensors are different.

6 Claims, 4 Drawing Sheets

(56) References Cited

U.S. PATENT DOCUMENTS

| | | | | |
|---|---|---|---|---|
| 2010/0322651 | A1* | 12/2010 | Yoshizawa | 399/66 |
| 2010/0326251 | A1 | 12/2010 | Simon | |
| 2012/0067186 | A1 | 3/2012 | Keller et al. | |
| 2013/0291697 | A1* | 11/2013 | Keller et al. | 83/102.1 |
| 2014/0130643 | A1* | 5/2014 | Dammertz et al. | 83/13 |
| 2014/0311310 | A1* | 10/2014 | Koegel | 83/72 |

* cited by examiner

GUARD DETECTION SYSTEM FOR A POWER TOOL

REFERENCE TO RELATED APPLICATION

This application claims priority under 35 U.S.C. § 119 to U.S. Provisional Application No. 61/776,823 filed Mar. 12, 2013, the disclosure of which is incorporated herein by reference in its entirety.

FIELD OF DISCLOSURE

The present disclosure relates to the field of power tools, such as portable or bench top power tools, and particularly to automated safety systems for such tools.

BACKGROUND

A portable power tool 100 shown in FIG. 1 includes a table 102 with a work surface 104 for supporting a workpiece. The table defines a slot 109 through which a cutting tool 108, such as a rotary saw blade, extends. The cutting tool is typically powered by a drive motor (not shown) and is adjustably supported by apparatus 110 beneath the work surface of the table 102. For instance, the apparatus 110 may include components for adjusting the height or angle of the cutting tool 108 relative to the work surface. The components may be manual, such as a hand crank and gearing, or may be motor-driven. The apparatus 110 will also include one or more activation switches to control the operation of the various components of the power tool 100, including a mains switch 112 that controls the drive motor for the tool.

Power tools require various safety devices or mechanisms to prevent injury to the tool operator. Some safety devices are integrated into the control system, such as automatic shut-off features. Other safety devices are mechanical, in the nature of shields and guards that prevent the operator from accidentally coming into contact with an operating tool, such as a rotary saw blade 108 rotating at no-load or operating speeds. One such mechanical safety device is a riving knife 106 that is positioned within the downstream end of the slot 109 to reduce the likelihood of a kick-back event in which the workpiece gets caught or bound up during a cutting operation. As shown in FIG. 2, the riving knife includes a mounting slot 120 that allows the riving knife to be retracted beneath the work surface 104. A clamping mechanism 122 (see also FIG. 3) engages the slot 120 of the riving knife and allows the operator to raise or lower the knife to position it as desired, such as when performing a partial cut in the workpiece. The clamping mechanism 122 is supported on a carriage 124 that forms part of the apparatus 110 associated with the tool 108. One example of a riving knife arrangement is disclosed in U.S. Pat. No. 8,127,648, which issued on Mar. 6, 2012.

As seen in FIGS. 1, 2, the riving knife protects the downstream end of the tool or saw blade 108. Even when the riving knife is fully extended, an upstream portion of the blade 108 is still exposed. Consequently, many safety systems for power tools include an upper guard, such as the upper guard 132 shown in FIGS. 3, 4. The upper guard includes a lower edge 135 configured to contact the surface of the workpiece continuously as the cut is being performed. For optimum safety the riving knife and upper guard would be permanently mounted to the power tool 100. However, the reality of decades of historical use of table saws is that commercial artisans as well as experienced woodworkers want to and do use table saws to make specialty cuts, including non-through cuts, plunge cuts, cove cuts and dado cuts, for example. A plunge cut is made by placing a workpiece on the saw with the blade retracted, turning on the motor and cranking the blade upwardly to make a cut more or less to the middle of the work piece. A dado cut and a cover cut are other specialty non-through cuts utilizing special tools. Consequently, the upper guard 132 is typically removably supported on a mounting portion 130 of the riving knife by a mounting mechanism 134 that allows the upper guard to pivot when mounted to the riving knife. One example of a removably mounted upper guard is shown in U.S. Pat. No. 8,096,220, which issued on Jan. 17, 2012.

While it may be desirable for the upper guard to be removed for specialty or non-through cuts, for through cuts it is important to have the riving knife 106 and upper guard 132 in proper position protecting the operator from the working blade 108. It is therefore desirable to integrate a safety apparatus into the tool 100 that helps prevent usage of the power tool without the safety mechanism properly in place.

SUMMARY

An improvement is provided for a power table saw having a table top surface with an opening through which a blade can extend, the blade being driven by a drive motor supported by a carriage relative to the top surface. A mains switch is selectively actuatable by an operator to provide power to the drive motor. The table saw further includes a riving knife slidably supported on the carriage to selectively position the riving knife in an extended position in which the riving knife extends through the opening adjacent the blade and a retracted position in which the riving knife is retracted below the table top surface. A blade guard is removably mounted to the riving knife in a position above the blade.

In one aspect of the present disclosure, the improvement includes a sensible element mounted to the riving knife and a first sensor having a non-null state when the sensible element is adjacent the first sensor and a null state otherwise. The sensible element and first sensor are oriented on the power table saw so that the sensible element is adjacent the sensor when the riving knife is in its retracted position. The first sensor thus has a non-null state when the riving knife is retracted and a null state when the riving knife is extended.

In a further aspect, a second sensor is provided that is configured to detect the presence of the blade guard. The second sensor has a null state when the blade guard is detected and a non-null state otherwise. The power saw further includes a controller that is operable to determine the states of the first and second sensors and to disengage power to the drive motor when the mains switch is actuated when the states of the first and second sensors are different.

By way of example, if the riving knife is retracted but the blade guard is engaged to the riving knife, the first sensor will have a non-null state and the second sensor will have a null state. Since the two states are different the controller disengages power to the drive motor, even if the mains switch is actuated by the operator. On the other hand, if the riving knife is properly positioned and the blade guard is present, both sensors are in a null state. In this condition, the controller does not interrupt power to the drive motor.

In a further aspect, the controller does not interrupt power to the drive motor when both sensors are in their non-null state. The first sensor will have a non-null state when the riving knife is retracted and the second sensor non-null state is due to the absence of the blade guard. In this condition, both safety features are missing from the power saw, but operation is permitted so that the operator can perform a special cut, such as a non-through cut.

DETAILED DESCRIPTION

Figure 1:
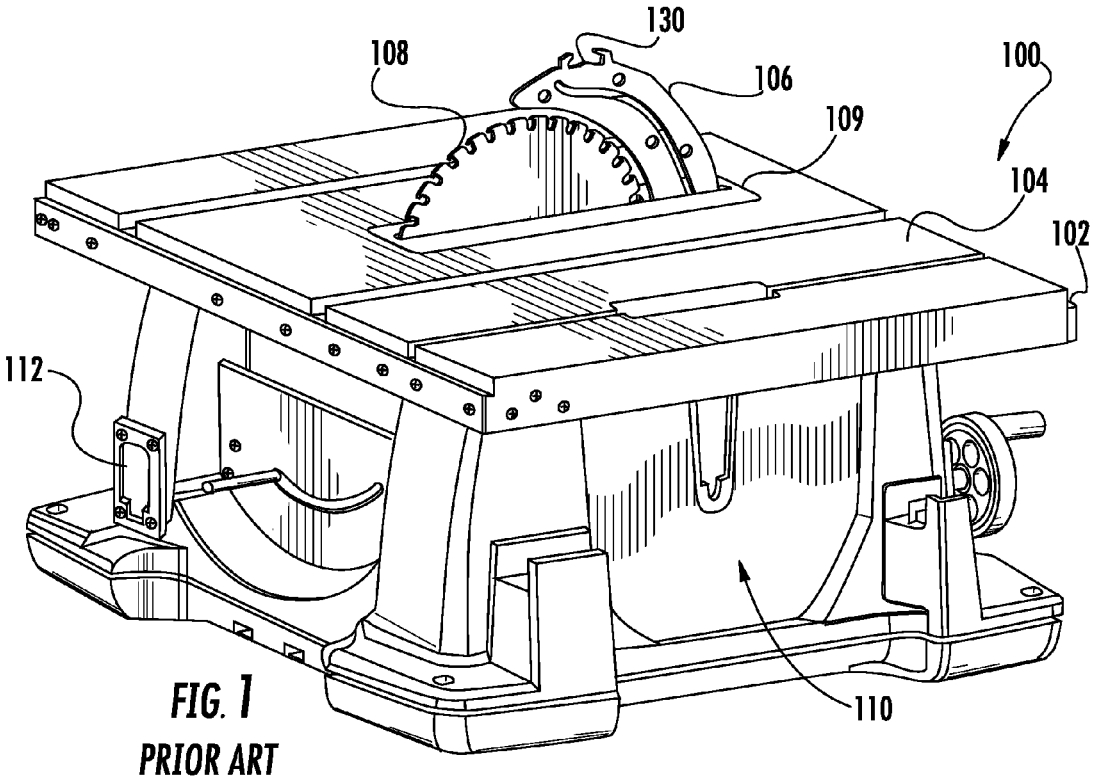
FIG. 1 PRIOR ART
FIG. 1 is a perspective view of a power tool for use with a guard detection system of the present disclosure.
Figure 2:
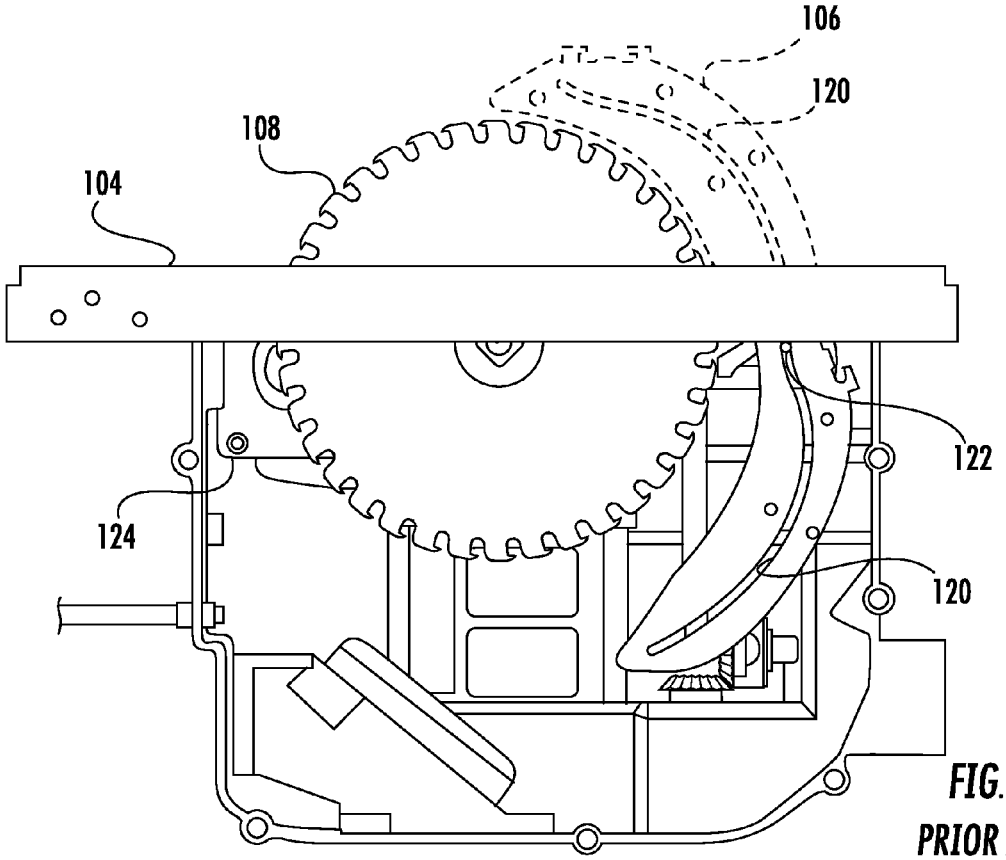
FIG. 2 PRIOR ART
FIG. 2 is a side partial cut-away view of the power tool of FIG. 1, shown with the riving knife in two positions relative to the work surface of the power tool.
Figure 3:
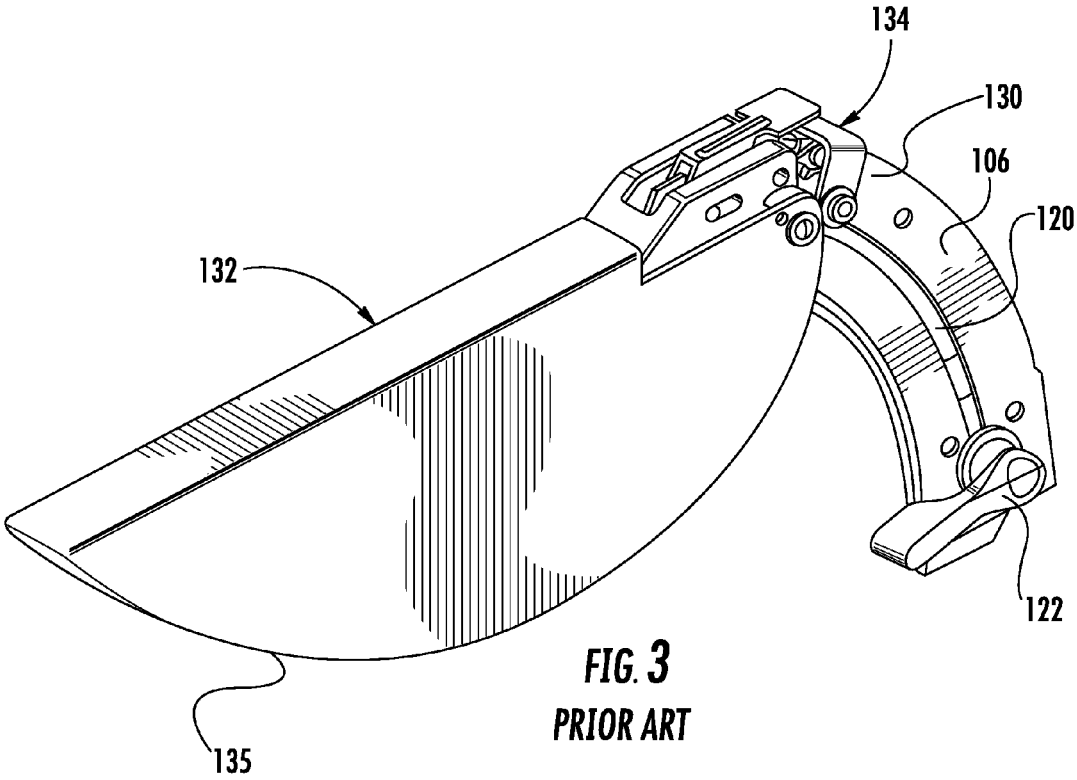
FIG. 3 PRIOR ART
FIG. 3 is an enlarged perspective view of an upper guard mounted on a riving knife usable with the power tool of FIG. 1.

For the purposes of promoting an understanding of the principles of the invention, reference will now be made to the embodiments illustrated in the drawings and described in the following written specification. It is understood that no limitation to the scope of the invention is thereby intended. It is further understood that the present invention includes any alterations and modifications to the illustrated embodiments and includes further applications of the principles of the invention as would normally occur to one skilled in the art to which this invention pertains.

Figure 4A:
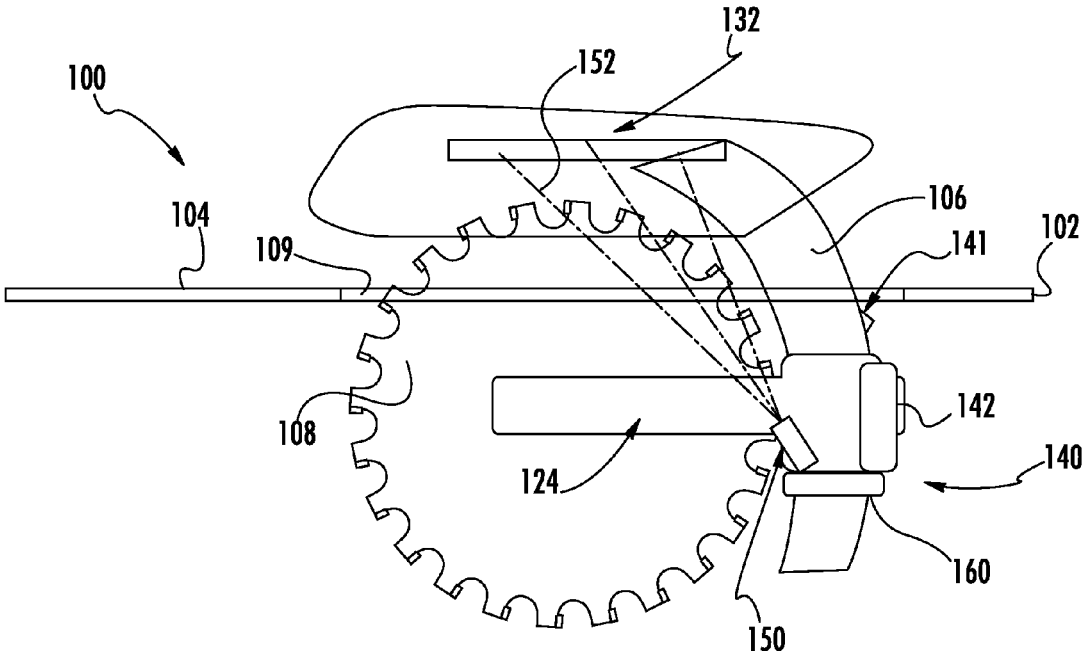
FIG. 4*a* is a side representation of a power tool showing the cutting blade, riving knife and upper guard, with a guard detection system of the present disclosure, with the riving knife and upper guard in position for a through cut of a workpiece.
Figure 6A:
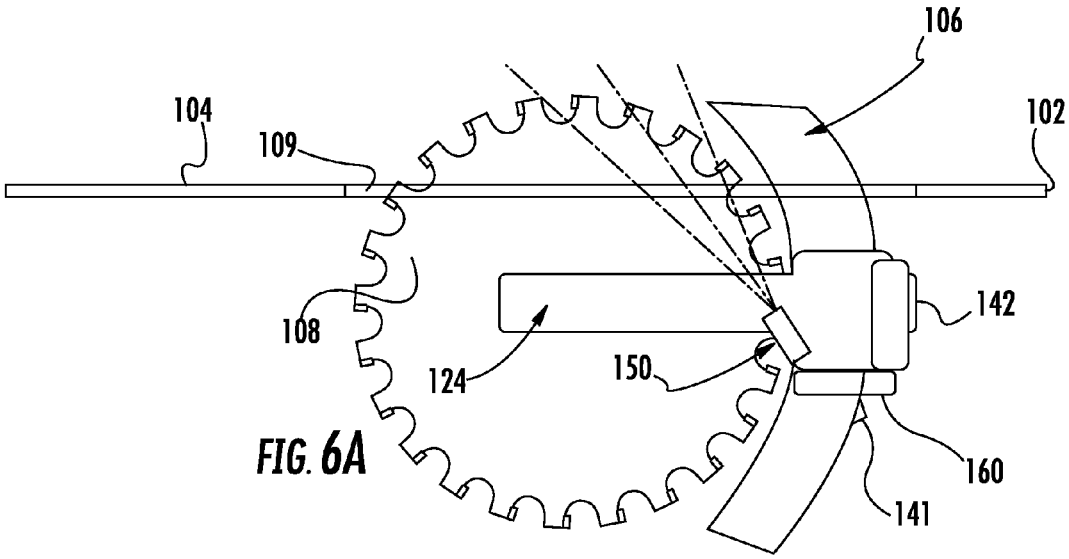
FIG. 6*a* is a side representation of a power tool showing the cutting blade, riving knife and upper guard, with a guard detection system of the present disclosure, with the riving knife and upper guard in position for a non-through cut of a workpiece.

Referring to FIG. 4*a*, the power tool 100 is provided with a guard detection system 140 that is associated with the riving knife 106 and upper guard 132. In one aspect, the system 140 includes a first sensor 142 mounted on the carriage 124 that supports the riving knife 106, in which the sensor is adapted to sense a current position of the riving knife. The riving knife may include an indicia or sensible element 141 that is sensed by the first sensor 142. The element 141 and sensor 142 are configured to generate one signal when the riving knife is extended above the work surface 104, as shown in FIG. 4*a*, and to generate a different signal when the knife is refracted below the surface, as shown in FIG. 6*a*. In other words, the sensible element and sensor may be configured to be in a null state (0) when the riving knife 106 is properly positioned on the power tool and to be in a non-null state (1) when the knife is retracted.

Figure 4B:
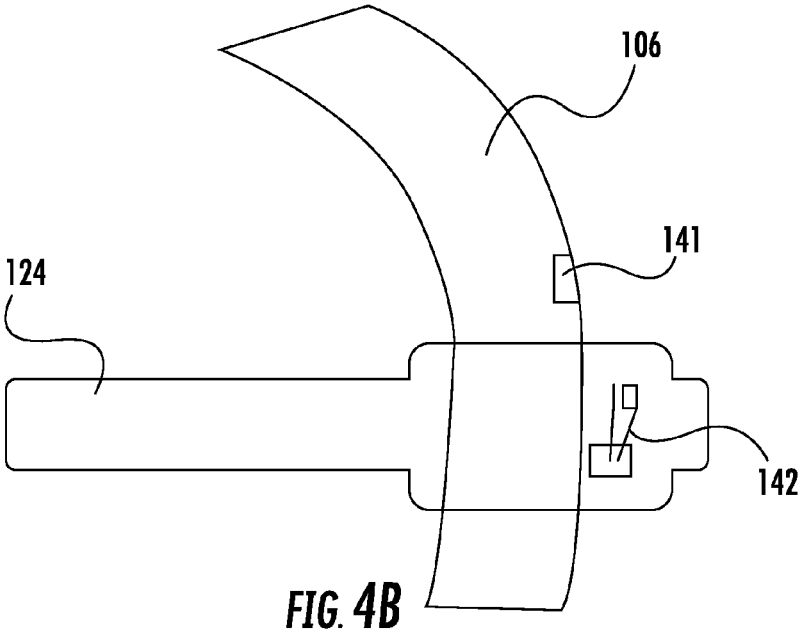
FIG. 4*b* is an enlarged side view of the guard detection system in a "null" or open configuration when the riving knife is extended as shown in FIG. 4*a*.
Figure 6B:
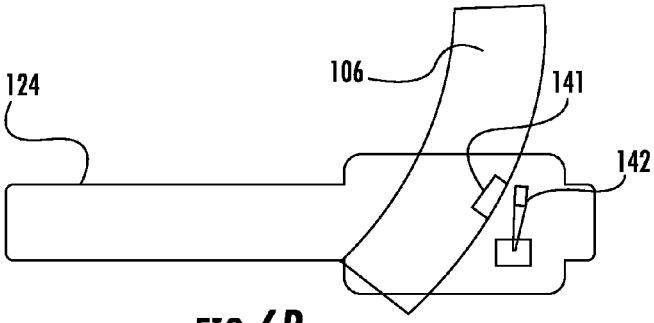
FIG. 6*b* is an enlarged side view of the guard detection system in a "non-null" or closed configuration when the riving knife is retracted as shown in FIG. 6*a*.

In one embodiment the sensible element 141 may be a magnet and the first sensor 142 may be a magnetic sensor, such as a reed switch, that is responsive to the magnetic field generated by the element, and more particularly that is configured to change state when the magnet is adjacent the sensor. When element 141 is physically above the sensor 142, such as when the riving knife is in its extended position, the reed switch may be open as depicted in FIG. 4*b*, leading to a null state or no signal since the switch is open. When the magnetic element 11 is below the sensor, such as when the riving knife is in its retracted position, the magnet element 141 pulls the reed switch closed as depicted in FIG. 6*b*, thereby changing the state of the switch to a non-null state in which a signal is generated because the switch is closed. The sensor 142 may be electrically connected to the power supply for the tool 100 independent of the mains switch 112, or may be provided with its own power supply, in order to generate the signal in the non-null state.

Other forms of sensors 142 and/or sensible elements 141 are contemplated that are capable of providing an indication of the position of the riving knife relative to the work surface 104. For instance, the sensible elements may be optical markings on a surface of the riving knife and the sensor may be an optical sensor. Alternatively, the sensor and sensible element may be elements of an electrical component such as a switch in which the switch is physically open when the knife is extended and physically closed with the knife is retracted. In this alternative the sensible element may be a projection on the riving knife and the switch may include a contact element that can be depressed on contact with the projection to close the switch. In a further alternative, the switch may include a resistance element that measures a change in electrical resistance based on the knife position, in the nature of a rheostat with the wiper of the rheostat mounted to the riving knife.

The position of the first sensor 142 and sensible element 141 may be adjusted so that the null state arises only when the riving knife is fully extended and the non-null state in which a signal is generated arises if the riving knife deviates from the fully extended position by a pre-determined amount (i.e., is only partially extended). As a further alternative, the sensor 142 may be configured to have three states, one indicative of a fully retracted riving knife (the null state) in which no signal is generated, another state indicating full retraction in which a non-null signal is generated, and a third state indicating partial retraction or extension in which a different non-null signal is generated. The signal in the third state may be useful to inform the tool operator if the riving knife is in a position to interfere with a non-through cut operation.

In a further aspect of the present disclosure, the guard detection system 140 includes a second sensor 150 configured to sense whether the upper guard 132 is mounted to the riving knife or is otherwise properly positioned on the power tool 100. The second sensor 150 may be mounted to the carriage 124 that adjustably supports the riving knife 106 or may be otherwise mounted on the power tool 100 in a fixed position relative to the riving knife. In one embodiment the second sensor 150 is an optical or laser sensor that transmits a light beam 152 through the blade slot 109 and parallel to the surface of the blade 108, as illustrated in FIG. 4*a*. The sensor 150 receives the reflected light beam if the upper guard 132 is mounted on the riving knife or otherwise properly positioned over the blade 108. Like the riving knife sensor 142, the second sensor 150 may be configured for a null state (0) when the upper guard is detected and a non-null state (1) when the upper guard is absent or is not properly detected by the sensor.

In one alternative, the upper guard 132 may be provided with a sensible element, similar to the element 141 on the riving knife discussed above. The second sensor 150 may then be configured to only detect the presence or absence of the sensible element, rather than the presence or absence of the entire upper guard.

The second sensor 150 may take on other forms suitable to detect whether the upper guard is mounted above the working tool. The sensor may thus be an optical-based sensor, such as the laser sensor described above, or a camera-based sensor that is appropriately configured to interpret the pixels of an image to ascertain whether the upper guard or the sensible element is present. The sensor may also be magnetic to sense a difference in magnetic characteristics in the vicinity of the blade 108 with or without the upper guard. The sensor may also be in the form of a switch that is activated by the physical presence of the upper guard. For instance, the switch may be incorporated into the mounting portion 130 of the riving knife to be closed if the mounting mechanism 134 of the upper guard is engaged to the mounting portion. The switch may also be arranged to be tripped by the increase in weight of the riving knife when the upper guard is mounted thereon. In this latter alternative, the sensor may be coupled to the carriage 124 to sense changes in the carriage under the increased weight when the riving knife and upper guard are both in position.

Figure 5:
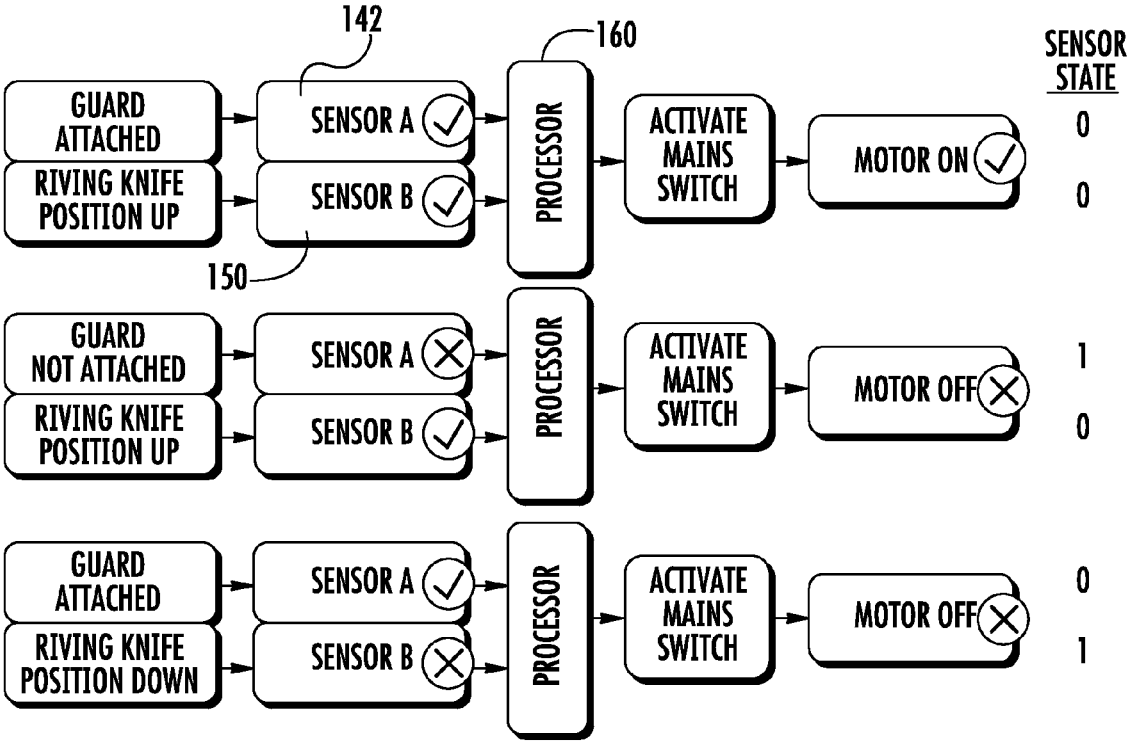
FIG. 5 is a chart of detection logic implemented by the guard detection system of the present disclosure for operation of the power tool to make the through cut of FIG. 4*a*.

In one aspect of the present disclosure, the two sensors 142 and 150 are coupled to a controller 160 that may be associated with the carriage 124 supporting the riving knife, or may be otherwise mounted in, at or on the power tool 100. In some embodiments, the sensors 142 and 150 are integrated into a single package with a common housing that defines a sensor package. The package can either mounted on the carriage 124, the guard detection system 140, or combination thereof. In other embodiments, the carriage, the guard detection system, or combination thereof contemplate that the sensing element and its housing are formed as part of a housing on the guard detection system and the carriage. The controller 160 receives the signals from the two sensors and controls whether the tool can be activated by the operator. In one embodiment, the controller is configured to act essentially as a circuit breaker between the mains switch 112 (FIG. 1) and the tool drive motor. As shown in the chart of FIG. 5, the controller only permits activation of the drive motor for the blade 108 if both sensors signal the presence of their respective safety components—i.e., sensor 142 signals that the riving knife 106 is fully extended and the first sensor 150 signals that the upper guard 132 is present. When the riving knife and upper guard are detected, the controller allows activation of the mains switch for the power tool to activate the drive motor for the blade. In the embodiments described above, the controller can interpret the null state (0) of each sensor as indicating the presence of the safety components and the non-null state (1) as indicating a lack of or improper positioning of the safety components.

If either sensor fails to detect their associated safety component (i.e., transmits a non-null (1) signal) the controller does not activate the drive motor even when the mains switch is activated by the operator. It is contemplated that the controller may also activate a visual or audible indicator informing the operator of the success or failure of the safety component test. The sensible indicator may be immediately adjacent the mains switch 112 or at some other location that is readily sensible by the tool operator. Optimally the indicator would only be activated in the event of a failed condition to avoid confusion of the operator. Moreover, the indicator may identify which safety component condition failed—i.e., whether the riving knife is not fully extended or whether the upper guard is absent. It can be noted that when the guard is detected but not the riving knife, the failure condition is that the upper guard may be contacted by the spinning cutting blade 108.

The controller 160 may be in the form of an electrical circuit configured to activate a circuit breaker on receipt of signals from the sensors indicative of missing or improperly positioned riving knife and upper guard. The electrical circuit may thus be responsive to specific voltages generated by the sensors when an error condition is detected. Alternatively, the controller 160 may be in the form of a processor, such as a microprocessor, with the sensors configured to provide a digital state signal (0 or 1) to the processor.

The action protocol of FIG. 5 is implemented by the processor when a full or through cut is being made in the workpiece. It can be noted that the sensor states in FIG. 5 do not include the state in which the upper guard is absent and the riving knife is retracted, such as depicted in FIG. 6*a*. When these two conditions exist the assumption is that the operator intends to make a non-through cut in the workpiece, such as the dado, plunge or cove cuts described above. In this case, the processor implements the protocol shown in FIG. 7. In this protocol, the blade motor is activated only if both safety devices are absent—i.e., the riving knife is retracted and the upper guard is absent. Using the example above, the processor permits activation of the drive motor if both sensors 142, 150 return a non-null (1) value. On the other hand, if the riving knife sensor indicates that the knife is extended (returning a null (0) value), the processor 160 prevents activation of the cutting blade motor even if the operator attempts to actuate the mains switch.

Figure 7:
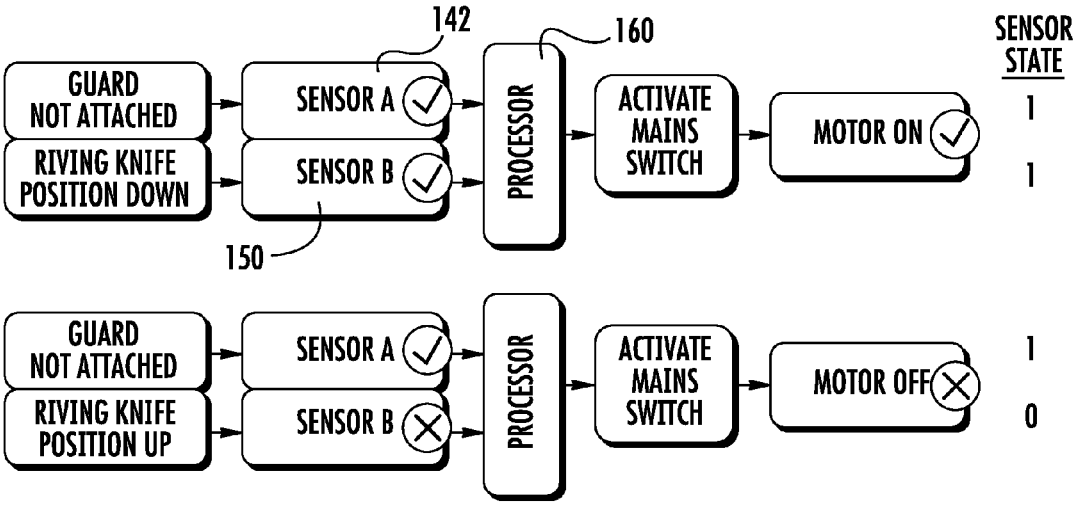
FIG. 7 is a chart of detection logic implemented by the guard detection system of the present disclosure for operation of the power tool to make the non-through cut of FIG. 6*a*.

It can be appreciated from the sensor state values shown in FIGS. 5 and 7 that the guard detection system, and more particularly the controller 160, only permits activation of the drive motor when the state values of the two sensors 142, 150 is the same. For a normal operating condition of the power tool, such as when performing a through cut, the sensor states must be (0,0) for the drive motor to be activated. On the other hand, for a specialty cut, such as a non-through cut, the sensor states must be (1,1) for the drive motor to be activated. The processor 160 may thus utilize a logical AND gate to control actuation of the drive motor when the mains switch is activated.

The controller 160 may be electrically interposed between the mains switch and the tool drive motor. The controller may be configured to initiate the safety device test sequence and protocols of FIGS. 5, 7 upon activation of a separate switch. However, this approach depends upon the operator who may have already forgotten to install the safety features. Thus, the controller 160 is preferably activated when the operator throws the mains switch 112 for the power tool. If the controller protocol determines that all of the safety features are in place, the circuit breaker aspect of the controller can be closed to allow activation of the drive motor. Since it is contemplated that the sensors are electrically or electronically based any delay between throwing the mains switch and activation of the drive motor should be minimal and probably not noticeable to the operator. On the other hand, if the controller 160 detects an error condition, the drive motor will not be activated and the operator will be informed of the safety error condition. For a controller 160 configured as a processor, the processor may be configured to periodically poll the two sensors after the mains switch has been activated and until the mains switch has been shut off by the operator. By periodically polling the sensors the processor can determine whether the safety error condition has been rectified, such as by installing the upper guard or moving the riving knife. Alternatively, and perhaps preferably, if a safety error condition is detected while the power tool is being operated, the processor may automatically shut off the mains switch, thereby requiring the operator to trip the switch again once the safety error condition has been corrected.

The guard detection system 140 may be incorporated into a sensory and actuation system for the power tool that senses and controls other aspect of the power tool operation. For instance, an automated height adjustment system may be implemented that is tied to the processor 160 so that the height adjustment feature is not activated unless all safety features are in place. The guard detection system may thus serve as a sentry for the power tool that does not allow any features to operate unless the safety features are activated. In its sentry role, the guard detection system may also be configured to shut the power tool down if a safety element is removed during a cutting operation. In this role, the processor 160 is constantly polling the sensors during operation of the power tool. It can of course be appreciated that the upper guard sensor 150 cannot rely on optically sensing the upper guard since the workpiece will span the tool slot 109 during a cutting operation.

The power tool described herein is a rotary saw, with safety devices appropriate to that type of tool, namely a riving knife and an upper guard. The guard detection system 140 may be modified to evaluate other safety devices for other types of power tools, and configured to control the activation of the corresponding tool based on whether safety error conditions exist.

The present disclosure contemplates a guard detection system for a power tool, such as a portable or bench top power tool, in which sensors detect the presence of safety features of the power tool, such as a riving knife and an upper guard for a rotary saw. A controller receives a signal from each sensor and implements a protocol that permits operation of the power tool drive motor or prevents operation of the drive motor even when the mains switch for the power tool has been actuated by the operator.

While the invention has been illustrated and described in detail in the drawings and foregoing description, the same should be considered as illustrative and not restrictive in character. It is understood that only the preferred embodiments have been presented and that all changes, modifications and further applications that come within the spirit of the invention are desired to be protected.

What is claimed is:

1. In a power table saw having a table top surface with an opening through which a blade can extend, the blade being driven by a drive motor supported by a carriage relative to the top surface, a mains switch selectively actuatable by an operator to provide power to the drive motor, a riving knife slidably supported on the carriage to be selectively positioned in an extended position in which the riving knife extends through the opening adjacent the blade and in a retracted position in which the riving knife is retracted below the table top surface and a blade guard removably mounted to the riving knife in a position above the blade, the improvement comprising:

a sensible element mounted to the riving knife;

a first sensor supported and arranged on the carriage to detect the sensible element when the riving knife is in the retracted position and configured to generate a signal when the sensible element is adjacent the sensor;

a second sensor supported and arranged on the carriage to detect the presence of the blade guard and configured to generate a signal in response thereto; and a controller operable while the mains switch is actuated to disengage power to the drive motor upon receipt of the signal from either of said first sensor or said second sensor.

2. The improvement of claim 1, wherein:

the sensible element is a magnet; and the first sensor includes a magnetic switch that is configured to change state in response to the magnetic field of the magnet when the magnet is adjacent the switch.

3. The improvement of claim 2, wherein the magnetic switch is configured to be open in the absence of the magnet and to be closed in response to the magnetic field.

4. The improvement of claim 1, wherein said second sensor is an optical sensor configured to optically sense the presence of the blade guard.

5. The improvement of claim 4, wherein the optical sensor is configured to direct an optical beam through the opening in the table top surface to shine on the blade guard and to receive the reflected optical beam if the blade guard is detected.

6. In a power table saw having a table top surface with an opening through which a blade can extend, the blade being driven by a drive motor supported by a carriage relative to the top surface, a mains switch selectively actuatable by an operator to provide power to the drive motor, a riving knife slidably supported on the carriage to be selectively positioned in an extended position in which the riving knife extends through the opening adjacent the blade and in a retracted position in which the riving knife is retracted below the table top surface, and has a blade guard removably mounted to the riving knife in a position above the blade, the improvement comprising:

a sensible element mounted to the riving knife;

a first sensor having a non-null state when the sensible element is adjacent the first sensor and a null state otherwise;

a second sensor configured to detect the presence of the blade guard and having a null state when the blade guard is detected and a non-null state otherwise; and a controller operable after the mains switch is actuated to determine the states of the first and second sensors and to;

disengage power to the drive motor when the states of the first and second sensors are different; and automatically permit power to the drive motor when the states of the first and second sensors are both null or both non-null.

* * * * *